US006216716B1

(12) United States Patent
Göbel

(10) Patent No.: US 6,216,716 B1
(45) Date of Patent: Apr. 17, 2001

(54) MOSQUITO NET

(75) Inventor: Eberhard Göbel, Ulm (DE)

(73) Assignee: Eberhard Gobel GmbH & Co., Ulm (DE)

( * ) Notice: Subject to any disclaimer, the term of this patent is extended or adjusted under 35 U.S.C. 154(b) by 0 days.

(21) Appl. No.: 09/214,650

(22) PCT Filed: May 14, 1997

(86) PCT No.: PCT/DE97/01012

§ 371 Date: Jan. 5, 1999

§ 102(e) Date: Jan. 5, 1999

(87) PCT Pub. No.: WO98/01061

PCT Pub. Date: Jan. 15, 1998

(30) Foreign Application Priority Data

Jul. 10, 1996 (DE) ..... 296 11 991 U

(51) Int. Cl.[7] ..... E04H 15/44

(52) U.S. Cl. ..... 135/126; 135/128; 135/137; 135/143

(58) Field of Search ..... 135/128, 137, 135/143, 124, 126

(56) References Cited

U.S. PATENT DOCUMENTS

| | | | | |
|---|---|---|---|---|
| 1,414,616 | | 5/1922 | Beehler . | |
| 2,475,515 | | 7/1949 | Potter . | |
| 4,825,892 | * | 5/1989 | Norman | 135/104 |
| 5,301,705 | * | 4/1994 | Zheng | 135/104 |
| 5,411,046 | * | 5/1995 | Wan | 135/126 |
| 5,778,915 | * | 7/1998 | Zheng | 135/126 |
| 5,816,278 | * | 10/1998 | Kim | 135/126 |

FOREIGN PATENT DOCUMENTS

| | | |
|---|---|---|
| 311 090 | 3/1918 | (DE) . |
| 2 062 860 | 6/1971 | (FR) . |

* cited by examiner

*Primary Examiner*—Beth A. Stephan
(74) *Attorney, Agent, or Firm*—Herbert Dubno

(57) ABSTRACT

The mosquito net of a mosquito-tight material (5) is characterized in that a closed, endless band (2) made of a flexible material is provided, which can be moved from an unstable balance position with a rolled-up or folded configuration into a stable balance position with an expanded configuration. Thereby the mosquito-tight material (5) is secured to the flexible band (2) in such a manner that in the expanded position an inner space, separated from the outer space by the mosquito-tight material, is created.

2 Claims, 1 Drawing Sheet

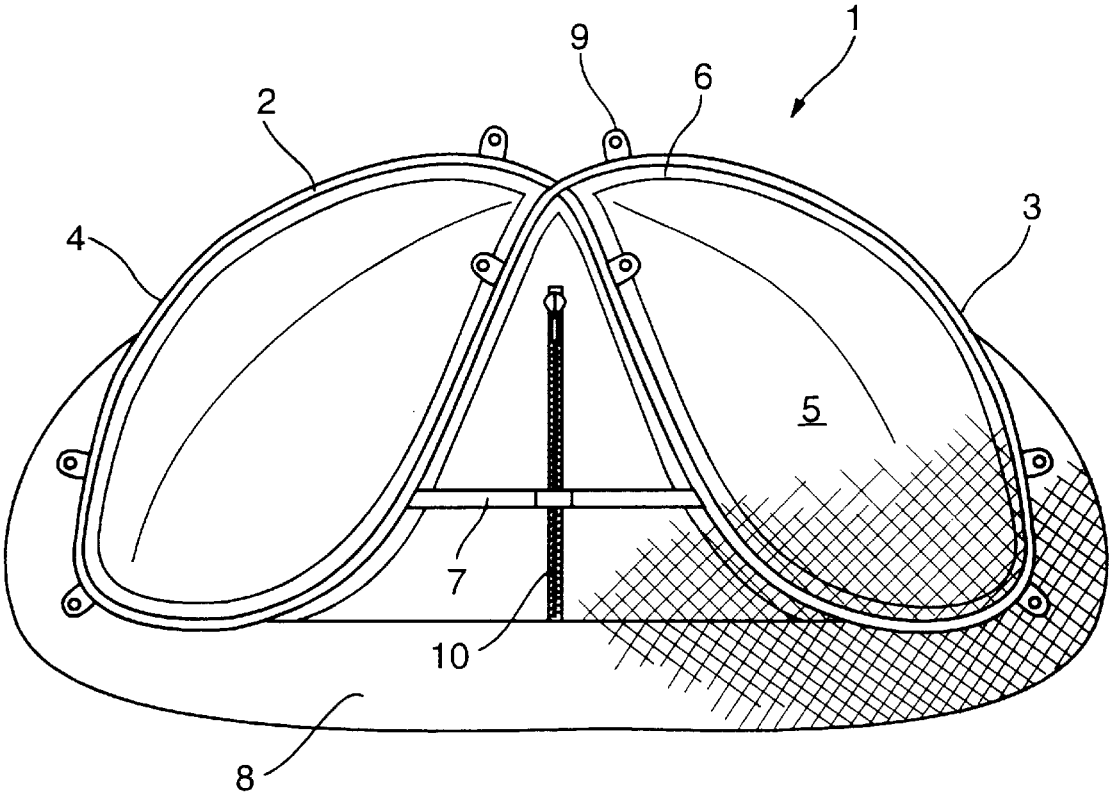
1
2
3
4
5
6
7
8
9
10

MOSQUITO NET

CROSS REFERENCE TO RELATED APPLICATIONS

This application is a national stage of PCT/DE 97/01012 filed May 14, 1997 and based on German application 296 11 991.1 of Jul. 10, 1996 under the International Convention.

FIELD OF THE INVENTION

The invention relates to a mosquito net made of mosquito-tight material.

BACKGROUND OF THE INVENTION

The heretofore known mosquito nets consist of a flat, sheet-like structure, which is suspended in its center over a bed or another space to be protected and hangs down from there under the effect of gravity. These mosquito nets do not assume a preferred shape, so that also there is no restoring force to prevent the mosquito net from preserving a loophole, in case such a loophole was formed.

OBJECT OF THE INVENTION

It is therefore the object of the invention to produce a mosquito net which can be used also in cases where there is no possibility to suspend it from a point, whereby it should also be insured that a person cannot be unintentionally entangled by kicking the mosquito net.

SUMMARY OF THE INVENTION

According to the invention, this object is achieved by providing a closed, endless band of a flexible material, which can be moved from a configuration of unstable balance under tension, wherein the band is rolled up or folded, to a configuration of stable balance, wherein the band is stretched, whereby the mosquito-tight material is secured to the band in such a manner that in the expanded configuration an inner space, separated from the outer space by the mosquito-tight material, is formed.

First of all the mosquito net of the invention offers the advantage that its protective effect can be insured very quickly and simply, namely by deflecting the unstable balance position to the point where it converts to the stable, energetically more favorable balanced position. Thereby no suspension points are required, but the mosquito net still adapts itself to the underlying object, so that a person can dwell without restrictions and obstructions under the mosquito net which has no suspension point.

A preferred embodiment of the invention is characterized in that the band in the stable position crosses itself in the middle, so that two loops are created, whereby respectively neighboring loop arms formed by one loop half are connected by the mosquito-tight material. In this embodiment, in the expanded configuration the flexible band has the shape of an 8, whereby due to the connection of neighboring loop arms the two loops are slightly inclined with respect to each other, so that an inner space similar to a dome-shaped tent is formed.

At each of two opposite sides a length-adjustable strap is provided, whose ends are fastened to the neighboring loop arms. By means of these straps it is possible to vary the angle between the two loops, whereby it is possible to adjust the space requirements of the mosquito net to the available space, without creating bulges and passage openings in the mosquito-tight material.

Suitably to the margin of the mosquito-tight material connected to the flexible band, a border is fastened, which in the set-up expanded configuration spreads out on the ground. This border insures that between mosquito net and ground there not only a linear contact, but that the border extends around the inner room, whereby it adjusts itself to the shape of the ground and lies flatly against the same.

On the flexible band, flaps with eyelets are arranged, by means of which the mosquito net can be anchored to the ground with tent pegs, on the other hand the flaps are also suitable for the suspension of the mosquito net, when the conditions make it possible.

Mosquito nets are frequently used by hikers, which carry the necessary hiking material on their bodies, respectively in their backpacks. Then it is advantageous to provide a strap by which the flexible band in its rolled-up, round configuration under tension can be transformed into an oblong configuration. In the rolled-up configuration the mosquito net can not be packed in the commercially available backpacks, since the diameter of the round configuration can not be reduced at will without damaging the flexible band. With the strap it becomes possible to change the shape of the flexible band, so that it would fit in a backpack.

Particularly when the mosquito net of the invention is affixed to the ground by tent pegs, it is advantageous to provide a zipper for entering the inner space, since in the closed position of the zipper a reliable tightness is afforded, which is not insured by the overlapping hanging layers of the mosquito net.

BRIEF DESCRIPTION OF THE DRAWING

The sole FIGURE of the accompanying drawing shows a mosquito net of the invention in its set up, expanded configuration.

SPECIFIC DESCRIPTION

The mosquito net 1 shown in the drawing has an endless, closed band 2 made of flexible material. This flexible band can be transferred from an unstable balance position under tension in an rolled-up configuration, to a stable balance position, whereby the flexible band 2 unwinds. In the stable balance position the flexible band 2 crosses itself once in the middle, so that the two loops 3, 4 are parts of a figure eight, and are inclined with respect to each other, since the neighboring loop arms formed by one loop half are correspondingly connected by the mosquito-tight material 5, which is sewn on to the casing 6 of the flexible band 2. Due to the mosquito-tight material 5 connecting neighboring loop arms, the mosquito net 1 shows the configuration illustrated in FIG. 1, whereby an inner space separated from the outer space by the mosquito-tight material 5 is formed. On the opposite loop arms of the two loops 3, 4, a length-adjustable strap 7 is arranged, by means of which the angle formed by the loops 3, 4 can be varied, so that the base surface of the mosquito net 1 can be altogether changed. To the margin connected to the flexible band 2 of the mosquito-tight material 5 a border 8 is fastened, which spreads out on the ground when the mosquito net 1 is set up. Further on the flexible band 2 flaps 9 with eyelets are arranged, which serve for insuring the stability of mosquito net 1. A zipper 10 is worked into the mosquito-tight material 5, through which it is possible to enter, respectively leave the inner space. The mosquito net 1 has a strap which is not shown in the drawing, by means of which the flexible band 2 in its unstable balance position can be converted to an oblong configuration.

What is claimed is:

1. A mosquito net made of a mosquito-tight material, comprising a closed, endless band made of a flexible material which can be moved from an unstable balance position under tension with a rolled up or folded configuration to a stable balance position with expanded configuration, whereby the mosquito-tight material is fastened to the flexible band in such a manner that in the stable balance position with expanded configuration an inner space is created and is separated from an outer space by the mosquito-tight material, and a border fastened along a margin of the mosquito-tight material and connected to the flexible band, said border being configured to spread out on the ground when the flexible band is in said stable balance position with expanded configuration.

2. A mosquito net made of a mosquito-tight material, comprising a closed, endless band made of a flexible material which can be moved from an unstable balance position under tension with a rolled up or folded configuration to a stable balance position with expanded configuration, whereby the mosquito-tight material is fastened to the flexible band in such a manner that in an expanded position an inner space is created which is separated from the outer space by the mosquito-tight material, said flexible band being formed with flaps having eyelets.

* * * * *